US006875970B2

(12) United States Patent
Kim

(10) Patent No.: US 6,875,970 B2
(45) Date of Patent: Apr. 5, 2005

(54) SAFETY APPARATUS FOR OUTPUT LEVEL-ADJUSTABLE MICROWAVE OVEN

(75) Inventor: Sun-Ki Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 42 days.

(21) Appl. No.: 10/377,599

(22) Filed: Mar. 4, 2003

(65) Prior Publication Data

US 2003/0226841 A1 Dec. 11, 2003

(30) Foreign Application Priority Data

Jun. 5, 2002 (KR) ..... 10-2002-0031479

(51) Int. Cl.[7] ..... H05B 6/74

(52) U.S. Cl. ..... 219/746; 219/721; 219/723; 219/716; 327/538; 331/86; 363/98; 361/103; 361/115; 361/93.9

(58) Field of Search ..... 219/716, 723, 219/746, 721; 327/538; 331/86; 363/98; 361/103, 115, 93.9, 37

(56) References Cited

U.S. PATENT DOCUMENTS 4,873,408 A 10/1989 Smith et al.
5,625,520 A * 4/1997 Lim ..... 361/103
5,894,396 A * 4/1999 Kim ..... 361/103

* cited by examiner

*Primary Examiner*—Shawntina Fuqua
(74) *Attorney, Agent, or Firm*—Staas & Halsey LLP

(57) ABSTRACT

A safety apparatus for an output level-adjustable microwave oven includes a fuse disposed in a power supply line that connects a high power relay or a low power relay with a primary coil of a high voltage transformer of the microwave oven. Where a wrong operation occurs due to defects in the relays, such as a melting of any one of the relays, the fuse disposed in the power supply line connected to the primary coil of the high voltage transformer is cut off. Accordingly, a potential fire resulting from the wrong operation is prevented.

20 Claims, 2 Drawing Sheets

SAFETY APPARATUS FOR OUTPUT LEVEL-ADJUSTABLE MICROWAVE OVEN

CROSS-REFERENCE TO RELATED APPLICATIONS

This application claims the benefit of Korean Patent Application No. 2002-31479, filed Jun. 5, 2002, in the Korean Intellectual Property Office, the disclosure of which is incorporated herein by reference.

BACKGROUND OF THE INVENTION

1. Field of the Invention

The present invention relates to a safety apparatus for an output level-adjustable microwave oven, and more particularly, to a safety apparatus for an output level-adjustable microwave oven that can prevent a fire caused by defects in relays that adjust an output level of the microwave oven.

2. Description of the Related Art

Generally, a microwave is an apparatus which cooks food using microwaves, and is provided with a high voltage transformer and a magnetron. The high voltage transformer operates the magnetron by generating a certain high voltage. The magnetron emits the microwaves of a high frequency, for example, about 2450 MHz, in a space where the food is deposited. The emitted microwaves vibrate water molecules contained in the food so as to heat and cook the food by a frictional heat generated by the vibration of the water molecules.

FIG. 1 shows a circuit diagram of a conventional output level-adjustable microwave oven. Here, the output level of the conventional microwave oven is adjusted by adjusting a number of windings of a primary coil of a high voltage transformer.

As shown in FIG. 1, first and second commercial Alternating Current (AC) lines L1 and L2 are connected at their one terminals to respective input terminals of a noise filter 1. The first and second commercial AC lines L1 and L2 supply 220V commercial Alternating Current (AC) power to a noise filter 1, and are connected at their other terminals to both terminals of a primary coil of a high voltage transformer HVT. The noise filter 1 includes elements, such as first and second fuses FUSE1 and FUSE2, capacitors C1 to C3, an inductor L, and a resistor R1.

The first fuse FUSE1 is connected to the first commercial AC line L1, and the second fuse FUSE2 is connected between the second commercial AC line L2 and a monitor switch SW2 (described hereinbelow).

First and second temperature switches TCO1 and TCO2, a door switch SW1 and the monitor switch SW2 are connected in series to the first commercial AC line L1. A high output relay RY1, a low output relay RY2 and an inrush relay RY3 are connected in parallel to the second commercial AC line L2.

The first temperature switch TCO1 is turned on or off according to a temperature of a magnetron MGT, so as to prevent overheating of the magnetron MGT. The second temperature switch TCO2 is turned on or off according to a temperature of a cooking chamber (not shown), so as to prevent overheating of the cooking chamber. The door switch SW1 and the monitor switch SW2 perform a safety function by being turned on or off according to an open or a closed state of a door (not shown). A lamp 2, a fan motor 3 and a drive motor 4 are connected between the first and second commercial AC lines L1 and L2.

A center tap A is provided midway between the terminals of the primary coil. The high voltage transformer HVT is connected at its center tap A to the high output relay RY1 through a first power supply line E1, and the high output relay RY1 is turned on or off by a microcomputer 7. The high voltage transformer HVT is connected at its one terminal to the low output relay RY2 through a second power supply line E2, and the low output relay RY2 is turned on or off by the microcomputer 7.

The inrush relay RY3 is operated for several minutes just before the low output relay RY2 is turned on, so as to remove an inrush current.

A secondary coil of the high voltage transformer HVT is connected to the magnetron MGT, a high voltage condenser HVC, a resistor R3, a high voltage diode HVD and a high voltage fuse H.V.FUSE.

The microcomputer 7 is connected to a display unit 5 and an input unit 6. The microcomputer 7 receives cooking commands of a user, such as a command to set a cooking menu and a start command, from the input unit 6. The display unit 5 displays various kinds of operational states, such as the setting of the cooking menu and cooking states of the microwave oven.

The microcomputer 7 drives the magnetron MGT in response to a cooking start command. Where it is required to generate a high output of 1100 W from the magnetron MGT, the microcomputer 7 controls the high output relay RY1 and the low output relay RY2 to be turned on and off, respectively. On the other hand, where it is required to generate a low output of 1000 W from the magnetron MGT, the microcomputer 7 controls the high output relay RY1 and the low output relay RY2 to be turned off and on, respectively.

However, the conventional microwave oven is problematic in that a fire may occur due to the defects in the relays RY1 and RY2, which adjust an output of the microwave oven, and there is no scheme to deal with such a hazard. That is, where any one of the relays RY1 and RY2 has melted due to the application of the inrush current, both the relays RY1 and RY2 may be simultaneously turned on in a process of adjusting the output of the microwave oven. In this case, an excessive current flows through the power supply lines E1 and E2, which may generate a high temperature heat and burn covering materials that shield the power supply lines E1 and E2. Accordingly, surrounding electrical parts may be damaged through a resulting fire.

SUMMARY OF THE INVENTION

Accordingly, it is an aspect of the present invention to provide a safety apparatus for an output level-adjustable microwave oven, which is capable of cutting off an excessive power supply using a circuit breaker disposed in a power supply line of a primary coil of a high voltage transformer.

Additional aspects and advantages of the invention will be set forth in part in the description which follows and, in part, will be obvious from the description, or may be learned by practice of the invention.

To achieve the above and/or other aspects of the present invention, there is provided a safety apparatus for an output level-adjustable microwave oven having a high voltage transformer and an output level which is adjustable by adjusting a winding ratio of the high voltage transformer, the safety apparatus comprising relays which are connected to a primary coil of the high voltage transformer so as to allow the high voltage transformer to have different winding ratios corresponding to at least two output levels, wherein the relays include a first relay which is connected to a center tap of the primary coil through a first power supply line so as to generate a high output of the output levels and a second relay which is connected to a terminal of the primary coil through a second power supply line so as to generate a low output of the output levels, and a circuit breaker which cuts off an excessive current that flows through the first and second power supply lines where the relays are simultaneously operated.

The circuit breaker may be a fuse which is cut off in response to the excessive current flowing in the power supply lines being larger than a predetermined value.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
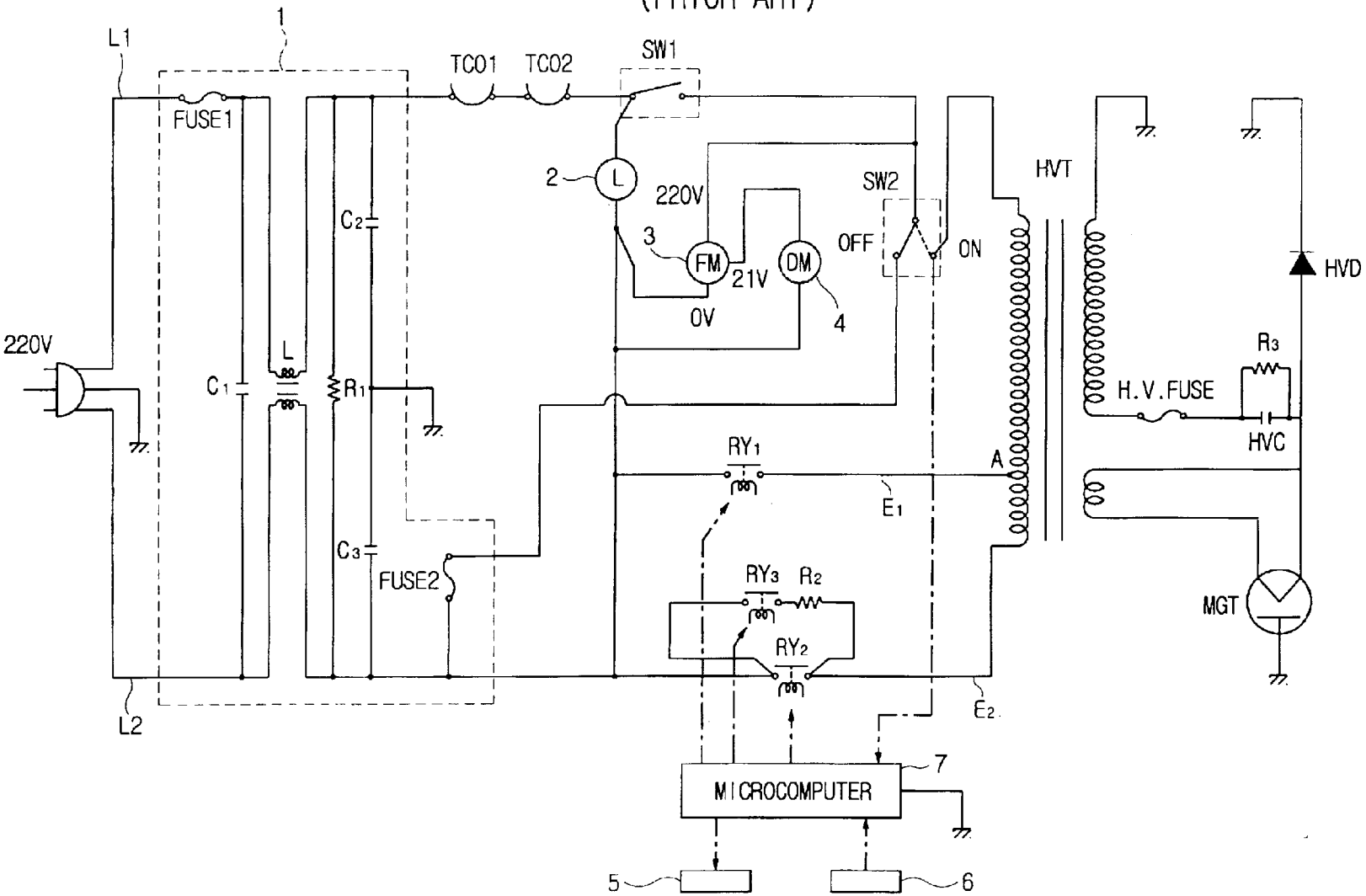
FIG. 1 (PRIOR ART)
FIG. 1 is a circuit diagram of a conventional output level-adjustable microwave oven.

Reference will now be made in detail to the embodiments of the present invention, an example of which is illustrated in the accompanying drawings, wherein like reference numerals refer to like elements throughout. The embodiments are described below in order to explain the present invention by referring to the figures.

Figure 2:
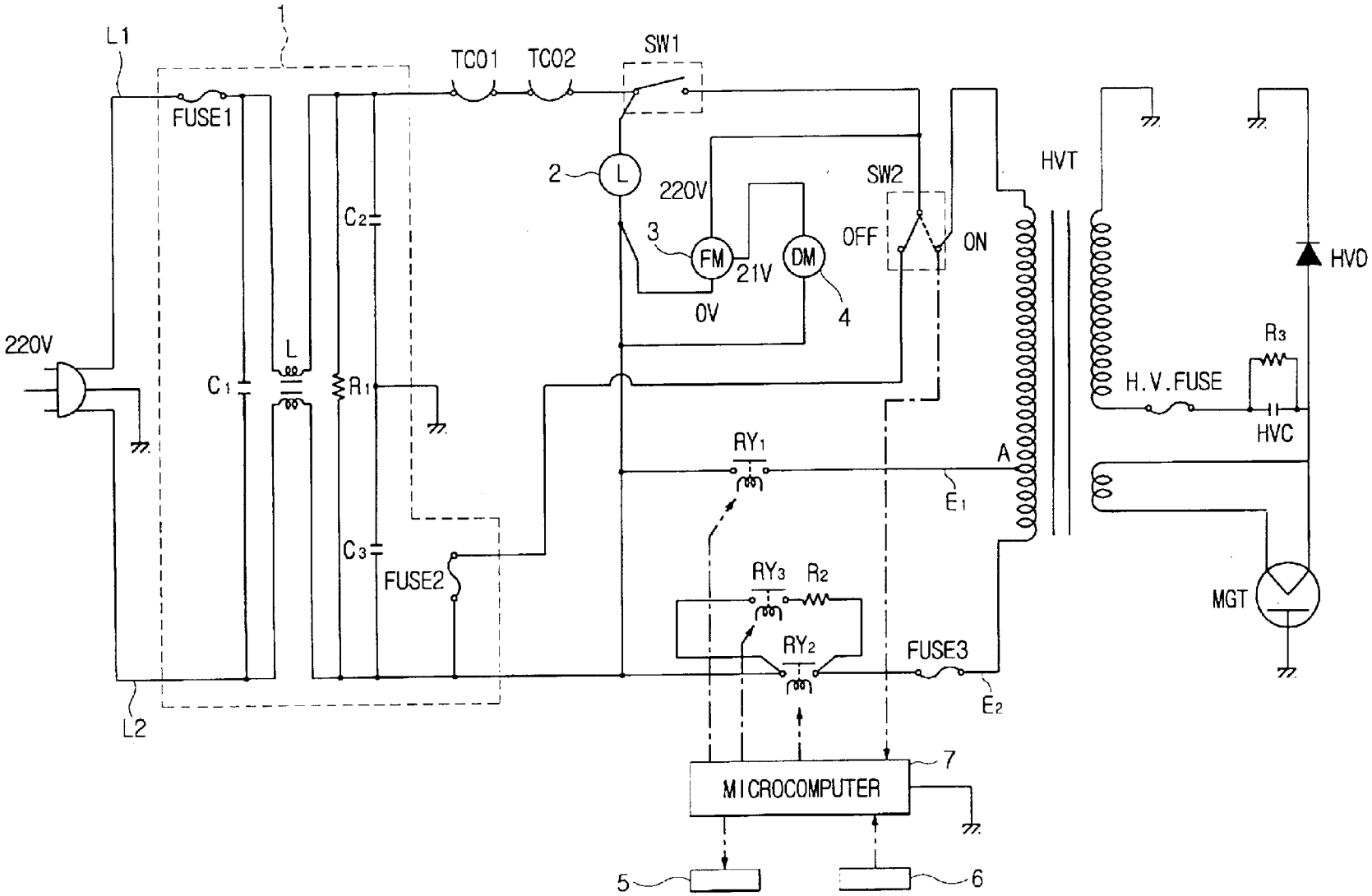
FIG. 2 is a circuit diagram of an output level-adjustable microwave oven in accordance with an embodiment of the present invention.

FIG. 2 shows a circuit diagram of an output level-adjustable microwave oven microwave oven according to an embodiment of the present invention. The same reference numerals are given for elements that carry out the same function as elements of the conventional microwave oven shown in FIG. 1.

As shown in FIG. 2, first and second commercial AC lines L1 and L2 are connected at their one terminals to respective input terminals of a noise filter 1, supply, for example, 220V commercial AC power to the noise filter 1, and are connected at their other terminals to both terminals of a primary coil of a high voltage transformer HVT.

A first fuse FUSE1 is connected to the first commercial AC line L1, and a second fuse FUSE2 is connected between the second commercial AC line L2 and a monitor switch SW2. First and second temperature switches TCO1 and TCO2, a door switch SW1 and the monitor switch SW2 are connected in series to the first commercial AC line L1. A high output relay RY1, a low output relay RY2 and an inrush relay RY3 are connected in parallel to the second commercial AC line L2.

A lamp 2, a fan motor 3 and a drive motor 4 are connected between the first and second commercial AC lines L1 and L2.

The high voltage transformer HVT is connected at its center tap A to the high output relay RY1 through a first power supply line E1. The high voltage transformer HVT is connected at its one terminal to the low output relay RY2 through a second power supply line E2. The relays RY1 and RY2 are turned on or off by a microcomputer 7. The inrush relay RY3 is operated for several minutes just before the low output relay RU2 is turned on, so as to remove an inrush current.

A secondary coil of the high voltage transformer HVT is connected to a magnetron MGT that generates microwaves, a high voltage condenser HVC, a resistor R3, a high voltage diode HVD and a high voltage fuse H.V.FUSE. The microcomputer 7 is connected to a display unit 5 and an input unit 6.

The microcomputer 7 drives the magnetron MGT in response to a cooking start command. Where it is required to generate a high output of, for example, 1100 W from the magnetron MGT, the microcomputer 7 controls the high output relay RY1 and the low output relay RY2 to be turned on and off, respectively. On the other hand, where it is required to generate a low output of, for example, 1000 W from the magnetron MGT, the microcomputer 7 controls the high output relay RY1 and the low output relay RY2 to be turned off and on, respectively.

Further descriptions of the above elements will be omitted to avoid repetition, in view of the descriptions corresponding to the elements of FIG. 1.

In this embodiment, as an example, a fuse FUSE3 is disposed in the power supply line E2 connected between the primary coil of the high voltage transformer HVT and the low output relay RY2 as a safety apparatus for the present microwave oven.

The fuse FUSE3 is used to deal with defects in the relays RY1 and RY2 operated by the microcomputer 7, and is cut off in response to an excessive current larger than a predetermined value flowing therethrough. While a low cost fuse FUSE3 is shown as the safety apparatus in this case, it is understood that other devices including a current trip circuit may be used instead of the fuse FUSE3.

Hereinbelow, an operation of the present invention is described in detail.

For example, the microcomputer 7, which controls the overall operation of the microwave oven, controls the elements of the microwave oven in response to a cooking start command input from the input unit 6.

The microcomputer 7 controls the high output relay RY1 and the low output relay RY2 to be reversely operated where a high output mode is converted into a low output mode or the low output mode is converted into the high output mode.

By way of an example, in the case where the microwave oven is operated at the low output of 1000 W, after the microwave oven is operated at the high output of 1100 W for a predetermined time, the microcomputer 7 controls the high output relay RY1 and the low output relay RY2 to be simultaneously turned on and off, respectively. Accordingly, the 220V commercial AC power is applied to the primary coil of the high voltage transformer HVT through the center tap A connected to the high output relay RY1. After the high output of 1100 W is generated for a predetermined time, the microcomputer 7 controls the high output relay RY1 and the low output relay RY2 to be simultaneously turned off and on, respectively, so as to convert the high output mode into the low output mode. Accordingly, the 220V commercial AC power is applied to the primary coil of the high voltage transformer HVT through the low output relay RY2. Where it is required to convert the high output mode into the low output mode, the microcomputer 7 controls the high output relay RY1 and the low output relay RY2 to be simultaneously turned on and off, respectively.

That is, the microcomputer 7 controls a corresponding one of the relays RY1 and RY2 on the basis of the operation mode, such as the high output mode or the low output mode, to be turned on, and controls the other relay to be simultaneously turned off.

However, where defects in the relays RY1 and RY2 occur, a wrong operation of the relay RY1 and RY2 may occur in the process of the microcomputer 7 controlling the operations of the relays RY1 and RY2 that adjust the output of the microwave oven.

In other words, in the case where the high output relay RY1 is melted and its contacts become connected to each other due to the application of the inrush current, the microcomputer 7 may output a control command to turn off the high output relay RY1 and to turn on the low output relay RY2 so as to drive the microwave oven in the low output mode. In this case, the high output relay RY1 is not turned off, so the two relays RY1 and RY2 are both turned on. Accordingly, where an excessive current flows through the power supply lines E1 and E2, the fuse FUSE3 is cut off by the excessive current. Consequently, the overheating of the power supply lines E1 and E2 is prevented, and a potential fire thereof is prevented.

While the fuse FUSE3 is disposed in the power supply line E2 in the above-described embodiment, it is understood that the fuse FUSE3 may be disposed in the power supply line E1 that connects the high power relay RY1 with the center tap A.

As describe above, where a wrong operation occurs due to defects in relays, such as a melting of any one of the relays in a process of adjusting an output of the microwave oven by controlling the operation of the relays, a fuse disposed in a power supply line connected to a primary coil of a high voltage transformer is cut off. Accordingly, the safety apparatus for the output level-adjustable microwave oven of the present invention, that is, a low cost fuse, prevents a potential fire hazard of the microwave oven and improves the reliability of the microwave oven.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A safety apparatus for an output level-adjustable microwave oven having a high voltage transformer and an output level which is adjustable by adjusting a winding ratio of the high voltage transformer, the safety apparatus comprising:

relays which are connected to a primary coil of the high voltage transformer so as to allow the high voltage transformer to have different winding ratios corresponding to at least two output levels, wherein the relays include:

a first relay which is connected to a center tap of the primary coil through a first power supply line so as to generate a high output of the output levels, and a second relay which is connected to a terminal of the primary coil through a second power supply line so as to generate a low output of the output levels; and a circuit breaker which cuts off an excessive current that flows through the first and second power supply lines where the relays are simultaneously operated.

2. The safety apparatus for an output level-adjustable microwave oven as set forth in claim 1, wherein the circuit breaker is a fuse which is cut off in response to the excessive current flowing in the first and second power supply lines being larger than a predetermined value.

3. The safety apparatus for an output level-adjustable microwave oven as set forth in claim 1, wherein the circuit breaker is a current trip circuit which cuts off the excessive current in response to the relays being simultaneously operated.

4. The safety apparatus for an output level-adjustable microwave oven as set forth in claim 1, wherein the circuit breaker is disposed in the first power supply line between the first relay and the center tap.

5. The safety apparatus for an output level-adjustable microwave oven as set forth in claim 1, wherein the circuit breaker is disposed in the second power supply line between the second relay and the terminal of the primary coil.

6. A safety apparatus for an output level-adjustable microwave oven having a high voltage transformer and an output level which is adjustable by adjusting a winding ratio of the high voltage transformer, the safety apparatus comprising:

relays which are connected to a primary coil of the high voltage transformer so as to allow the high voltage transformer to have different winding ratios corresponding to at least two output levels; and a circuit breaker which cuts off an excessive current that flows through power supply lines of the primary coil in response to the relays being simultaneously operated.

7. The safety apparatus for an output level-adjustable microwave oven as set forth in claim 6, wherein the circuit breaker is a fuse which is cut off in response to the excessive current flowing in the power supply lines being larger than a predetermined value.

8. The safety apparatus for an output level-adjustable microwave oven as set forth in claim 6, wherein the circuit breaker is a current trip circuit which cuts off the excessive current in response to the relays being simultaneously operated.

9. The safety apparatus for an output level-adjustable microwave oven as set forth in claim 6, wherein:

the power supply lines include first and second power supply lines, and the relays include:

a first relay which is connected to a center tap of the primary coil through the first power supply line so as to generate a high output of the output levels; and a second relay which is connected to a terminal of the primary coil through the second power supply line so as to generate a low output of the output levels.

10. The safety apparatus for an output level-adjustable microwave oven as set forth in claim 9, wherein the circuit breaker is disposed in one of the first power supply line and the second power supply line.

11. An output level adjustable microwave oven comprising:

a cooking chamber to contain food;

a magnetron which generates microwaves to cook the food;

a high voltage transformer which generates a high voltage for the magnetron;

a control unit which adjusts an output level of the microwave oven by adjusting a winding ratio of the high voltage transformer;

relays which are connected to a primary coil of the high voltage transformer so as to allow the high voltage transformer to have different winding ratios corresponding to at least two output levels; and a safety apparatus which cuts off an excessive current that flows through power supply lines of the primary coil in response to the relays being simultaneously operated.

12. The microwave oven as set forth in claim 11, wherein the safety apparatus is a fuse which is cut off in response to the excessive current flowing in the power supply lines being larger than a predetermined value.

13. The microwave oven as set forth in claim 11, wherein the safety apparatus is one of a circuit breaker and a current trip circuit, which cuts off the excessive current in response to the relays being simultaneously operated.

14. The microwave oven as set forth in claim 11, wherein:

the power supply lines include first and second power supply lines, and the relays include:

a first relay which is connected to a center tap of the primary coil through the first power supply line so as to generate a high output of the output levels; and a second relay which is connected to a terminal of the primary coil through the second power supply line so as to generate a low output of the output levels.

15. The microwave oven as set forth in claim 14, wherein the safety apparatus is disposed in one of the first power supply line and the second power supply line.

16. The microwave oven as set forth in claim 14, further comprising:

first and second current lines having their one ends connected to respective input terminals of a noise filter of the microwave oven, and their other ends connected to respective terminals of the high voltage transformer;

first and second temperature switches which are turned on or off according to a temperature of the magnetron and the cooking chamber, respectively, and connected in series to the first current line;

first and second monitoring switches which are turned on or off according to an open state or a closed state of the cooking chamber, and connected in series to the first current line;

an inrush relay which removes an inrush current of the microwave oven, wherein the inrush, first, and second relays are connected in parallel to the second current line;

an input unit which receives cooking information; and a display unit which displays operating information of the microwave oven.

17. The microwave oven as set forth in claim 11, wherein the microwave oven is a wall-mountable microwave oven.

18. A safety apparatus for an output level-adjustable microwave oven having a high voltage transformer and relays which are connected to a primary coil of the high voltage transformer, the safety apparatus comprising a circuit breaker which is disposed in a power supply line that connects one of the relays with the primary coil.

19. The safety apparatus for an output level-adjustable microwave oven as set forth in claim 18, wherein the circuit breaker is a fuse which is cutoff in response to the relays being simultaneously operated.

20. The safety apparatus for an output level-adjustable microwave oven as set forth in claim 18, wherein the one relay is connected to a center tap of the primary coil.

* * * * *